US008094863B2

(12) United States Patent
Ding

(10) Patent No.: US 8,094,863 B2
(45) Date of Patent: Jan. 10, 2012

(54) SEPARATE SUPPORT STRUCTURE FOR LOUDSPEAKER DIAPHRAGM

(76) Inventor: Yi Ding, Shanghai (CN)

( * ) Notice: Subject to any disclaimer, the term of this patent is extended or adjusted under 35 U.S.C. 154(b) by 781 days.

(21) Appl. No.: 12/159,347

(22) PCT Filed: Nov. 13, 2006

(86) PCT No.: PCT/CN2006/003047

§ 371 (c)(1),
(2), (4) Date: Jun. 26, 2008

(87) PCT Pub. No.: WO2007/076677

PCT Pub. Date: Jul. 12, 2007

(65) Prior Publication Data

US 2009/0010480 A1 Jan. 8, 2009

(51) Int. Cl.
*H04R 7/04* (2006.01)
*H04R 7/16* (2006.01)
*H04R 7/20* (2006.01)

(52) U.S. Cl. ..... 381/398

(58) Field of Classification Search ..... 381/395, 381/398, 423, 361, 368
See application file for complete search history.

(56) References Cited

U.S. PATENT DOCUMENTS

| | | | | |
|---|---|---|---|---|
| 4,122,314 | A * | 10/1978 | Matsuda et al. | 381/425 |
| 5,521,886 | A * | 5/1996 | Hirosawa et al. | 367/174 |
| 6,130,952 | A * | 10/2000 | Akino et al. | 381/368 |
| 6,728,389 | B1 * | 4/2004 | Bruney | 381/398 |
| 6,888,947 | B2 * | 5/2005 | Takeshima et al. | 381/190 |
| 6,925,191 | B2 * | 8/2005 | Petroff et al. | 381/423 |
| 7,382,893 | B2 * | 6/2008 | Baeten | 381/416 |
| 7,480,392 | B2 * | 1/2009 | Shin et al. | 381/419 |
| 7,528,509 | B2 * | 5/2009 | Ueda et al. | 310/15 |
| 7,929,724 | B2 * | 4/2011 | Funahashi | 381/398 |
| 7,974,433 | B2 * | 7/2011 | Andersen et al. | 381/398 |
| 7,974,434 | B2 * | 7/2011 | Funahashi | 381/398 |
| 8,009,856 | B2 * | 8/2011 | Funahashi | 381/398 |
| 2003/0202673 | A1 * | 10/2003 | Tajima et al. | 381/386 |
| 2004/0130242 | A1 * | 7/2004 | Buhler et al. | 310/324 |
| 2004/0130243 | A1 * | 7/2004 | Buhler et al. | 310/324 |
| 2005/0115762 | A1 * | 6/2005 | Ito | 181/166 |
| 2005/0220320 | A1 * | 10/2005 | Kim et al. | 381/396 |
| 2008/0043061 | A1 * | 2/2008 | Glezer et al. | 347/53 |
| 2008/0317275 | A1 * | 12/2008 | Funahashi | 381/398 |

(Continued)

FOREIGN PATENT DOCUMENTS

CN 1390431 A 1/2000

(Continued)

OTHER PUBLICATIONS

International Search Report of PCT/CN2006/003047.

*Primary Examiner* — Mary Wilczewski
(74) *Attorney, Agent, or Firm* — Hamre, Schumann, Mueller & Larson, P.C.

(57) ABSTRACT

A support structure for supporting and protecting the diaphragm of loudspeaker includes a first elastomer which has a first interface with a camber shape, a second elastomer which has a second interface with a complemental shape of the first interface, the first elastomer and the second elastomer combine together from both sides of the support part of the loudspeaker diaphragm. The separate support structure in the present invention is fit for many kinds of loudspeakers and propitious to increase the technical characteristics of loudspeakers.

10 Claims, 8 Drawing Sheets

U.S. PATENT DOCUMENTS

| | | | | |
|---|---|---|---|---|
| 2009/0010480 | A1* | 1/2009 | Ding | 381/395 |
| 2010/0220889 | A1* | 9/2010 | Adelman | 381/412 |
| 2011/0026757 | A1* | 2/2011 | Takahashi et al. | 381/397 |
| 2011/0044490 | A1* | 2/2011 | Makino | 381/398 |
| 2011/0116658 | A1* | 5/2011 | Mimura et al. | 381/120 |

FOREIGN PATENT DOCUMENTS

| | | | |
|---|---|---|---|
| JP | 11-275690 | A | 10/1999 |
| JP | 2003-153378 | A | 5/2003 |

* cited by examiner

SEPARATE SUPPORT STRUCTURE FOR LOUDSPEAKER DIAPHRAGM

TECHNICAL FIELD

The invention relates to the field of electroacoustical technology, more specially to a support structure for positioning of a diaphragm in a loudspeaker and keeping vibration of the diaphragm. In particular, the present invention relates to a separate kind of support structure for the diaphragm.

BACKGROUND OF THE INVENTION

Diaphragms used in most of the cone and dome loudspeaker in the present market are supported by means of a fold-ring (some including a centering tab), the fold-ring supports the diaphragm so that the diaphragm vibrates under the action of a electroacoustical driving force to output the sound, and the fold-ring and the diaphragm form an integral structure. Some fold-rings and diaphragms are made of same material, both being an integral structure; some fold-rings and diaphragms are made of different materials, both also being an integral structure by bonder means.

A lot of efforts are made on the diaphragm, fold-ring and material, as well as technologies in the art in order to obtain the better performance for the loudspeaker. However, the maturated product which is characteristic of the integral support structure is difficult to make a great breakthrough in the technical performance with the state of the art, in particular in the high-pitch and super-high-pitch field.

In the conventional ribbon loudspeaker, an aluminum ribbon diaphragm with thickness in the range of about 0.006-0.02 mm is generally used, which is constructed as corrugation to support and keep the vibration of the diaphragm. Although this loudspeaker is an excellent high-pitch unit, the corrugated aluminum ribbon diaphragm is susceptible to slack when it is operated by an electromagnetic force in long term and other strong external force. The diaphragm may become elongated and offset the center area of the magnetic clearance so as to generate distortion at work, the problem concerning the reliability and service life is hard to be resolved over a long time of period.

Recently a compound diaphragm of polyimide and aluminum foil has been used in the ribbon loudspeaker, and in a head of the ribbon diaphragm a metal spring in a waveform as a transition section of the support-structural member serves as the integral support structure, which improves the reliability and service life of the ribbon diaphragm in a certain extent, however the problem of stress concentration at a interface between the strip compound diaphragm and the waveform supporting-structural member is still difficult to be resolved since it is not perfect technically.

In the planar-film loudspeaker, the diaphragm is a compound plastic-aluminium-foil diaphragm, which is made of the film such as polyester and polyimide as the basic material by means of flexible circuit board technology. The planar-film diaphragm vibrates with the help of the elasticity generated by the plastic film between the retain ring around the planar-film diaphragm and the flexible circuit board. In order to ensure that the diaphragm vibrates with sufficient elasticity, the elastic retain ring of the planar-film diaphragm must have a predetermined width, which results in increasing the total area of the diaphragm of the planar-film loudspeaker. Recently, some of the planar-film loudspeakers available in the market are formed by polyimide as the basic material. This type product is tested after signal input, as a result, it is found that partial or entire diaphragm has permanent deformation. This means that the elasticity of the supporting ring of the diaphragm cannot sufficiently satisfy the requirement of the diaphragm vibration. As a result of the permanent deformation the diaphragm offsets the normal work area and produces distortion.

The above mentioned support structure of the three diaphragm has a common character that the support structure and the diaphragm are formed as an integral piece. This kind structure has a certain limitation in technology.

SUMMARY OF THE INVENTION

The object of the invention is to overcome the drawbacks above mentioned in the prior art, and to improve the performance of loudspeaker.

To this end, the loudspeaker diaphragm according to the invention is a separate kind of support structure, this support structure is used for positioning the loudspeaker diaphragm and keeping the vibration of diaphragm, wherein the support structure comprises: a first elastic body which has a first engaged face having a curved-surface shape; and a second elastic body which has a second engaged face, a curved-surface shape of the second engaged face complementarily matches the curved-surface shape of the first engaged face; the first engaged face of the first elastic body and the second engaged face of the second elastic body engage each other to clamp a supported portion of the loudspeaker diaphragm in opposite relation from two sides of the supported portion.

According to diaphragm support structure of the invention, the elastic bodies clamp the supported portion of the diaphragm by means of the engaged faces to keep supporting, there is no other connecting means such as an adhesive or the like between the elastic body and the diaphragm, hence a separate support structure is formed between the supported portion of the diaphragm and the curved-surface elastic body. In that manner, the curved-surface elastic bodies support and locate the diaphragm in a center work area for diaphragm with the supported portion, in work state the diaphragm keeps vibrating at the corresponding amplitude with the audio signal.

In the separate kind of support structure according to the invention, the loudspeaker diaphragm may be flexible or rigid.

In addition, compared with the integral support structure, for the cone and dome loudspeaker the separate support structure according to the invention eliminates the fold-ring to reduce the vibrating mass, which is particularly important for playing high frequency signal. Furthermore when the support structure of the present invention is applied to the ribbon loudspeaker and the planar-film loudspeaker, it may overcome the deficiency of the insufficient elastic deformation of the diaphragm material itself.

DESCRIPTION OF REFERENCE NUMERALS

Figure 1:
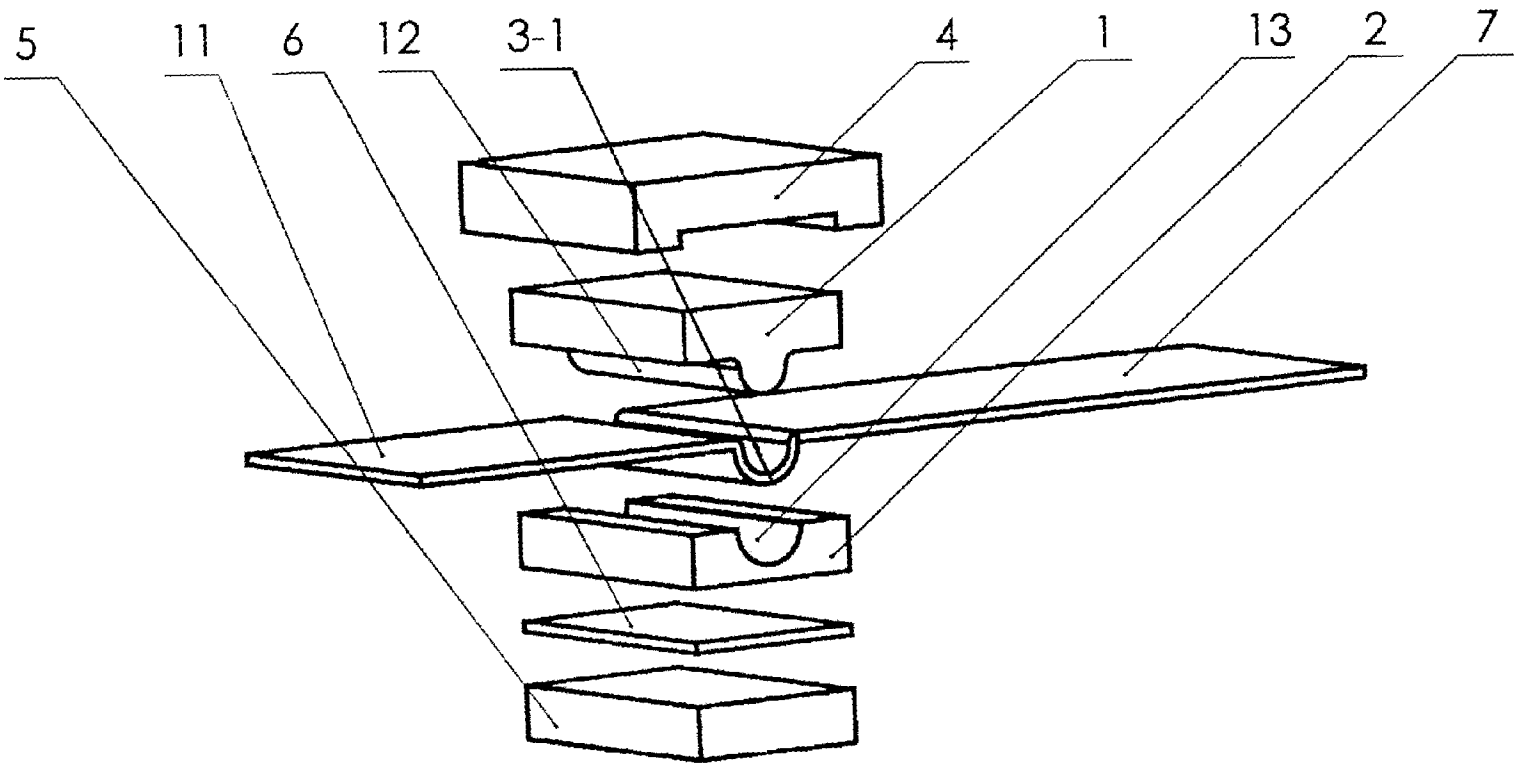
FIG. 1 is an exploded perspective view of the support structure of the loudspeaker diaphragm according to a first embodiment of the invention.

1 first curved-surface elastic body
2 second curved-surface elastic body
3-1 flexible supported portion
3-2 rigid supported portion
4 first fixation member of the curved-surface elastic body
5 second fixation member of the curved-surface elastic body
6 adhesive layer
7 flexible diaphragm
8 rigid diaphragm
9 first macromolecular curved-surface elastic body of hollow structure
10 second macromolecular curved-surface elastic body of hollow structure
11 fixed section of flexible diaphragm
12 engaged face of first curved-surface elastic body
13 engaged face of second curved-surface elastic body
14 fixed section of first metallic curved-surface elastic body
15 fixed section of second metallic curved-surface elastic body
16 first metallic curved-surface elastic body
17 second metallic curved-surface elastic body
18 first curved-surface elastic body in bar shape
19 second curved-surface elastic body in bar shape
20 second curved-surface elastic body in circular shape
21 second curved-surface elastic body in square shape (with rounded corner)
22 second curved-surface elastic body in U-shape
23 cone diaphragm
24 voice coil (winding)
25 dome diaphragm
26 electrical terminal of diaphragm conducting circuit for a planar-film loudspeaker
27 diaphragm conducting circuit for a planar-film loudspeaker

DETAILED DESCRIPTION OF THE INVENTION

Hereinafter, embodiments of the invention will be described in further detail with reference to the drawings.

In FIG. 1, there is shown a separate support structure for the loudspeaker diaphragm according to the first embodiment of the invention, and this kind of support structure is used for retaining the positioning of the diaphragm and keeping the vibration of the loudspeaker diaphragm. The support structure includes a first curved-surface elastic body 1, a second curved-surface elastic body 2 and a supported portion 3-1 of the loudspeaker diaphragm. In this embodiment, the first curved-surface elastic body 1 has a first engaged face 12 with a convex curved-surface shape, and the second curved-surface elastic body 2 has a second engaged face 13 with a concave curved-surface shape which is complementary to the curved-surface shape of the first curved-surface elastic body. The first engaged face 12 of the first curved-surface elastic body and the second engaged face 13 of the second curved-surface elastic body engage oppositely from both sides of the supported portion 3-1 of the loudspeaker diaphragm 7 and clamp the supported portion 3-1. It should be noted that there is no any connection means, such as an adhesive, between the first engaged face and the second engaged face, which is particularly benefit to the loudspeaker performance.

Figure 2:
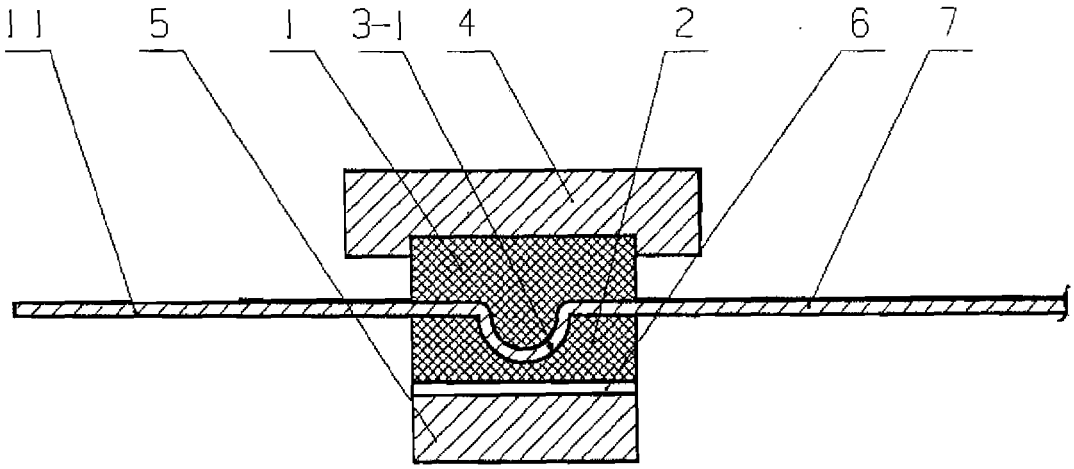
FIG. 2 is a sectional view of the support structure according to the loudspeaker diaphragm of the invention.

As shown in FIG. 2, in the first embodiment of the invention the diaphragm for the loudspeaker is a flexible diaphragm 7. The supported portion 3-1 of the diaphragm is sandwiched between both engaged faces of the two curved-surface elastic bodies 1 and 2, for example, the flexible diaphragm 7 may be a ribbon diaphragm for the ribbon loudspeaker or a planar-film diaphragm for the planar-film loudspeaker. A first fixation member for connecting to the curved-surface elastic body is denoted by reference numeral 4 in FIG. 2, the first curved elastic body 1 is fixed in the first fixation member 4 by means of insertion. A second fixation member for connecting to the curved-surface elastic body is denoted by the reference numeral 5, as shown in the figure, the second curved-surface elastic body 2 is fixed in the second fixation member 5 by means of an adhesive layer 6. It should be noted that the connection means between the fixation members and the elastic bodies is not limited, and the connection means may be selected according to the operation environment and manufacture technology.

The first and second curved-surface elastic bodies 1, 2 may be made of macromolecular resilient material, such as rubber, polyamino-rubber etc. In the ribbon loudspeaker and the planar-film loudspeaker, for example, the elastic bodies may preferably be made from thermal-resistant resilient material of macromolecule, such as fluo-rubber, silicon rubber etc, since the current flows through the conductive circuit in the diaphragm and the temperature may arise up to 100° C. or above under a maximum power.

Figure 8:
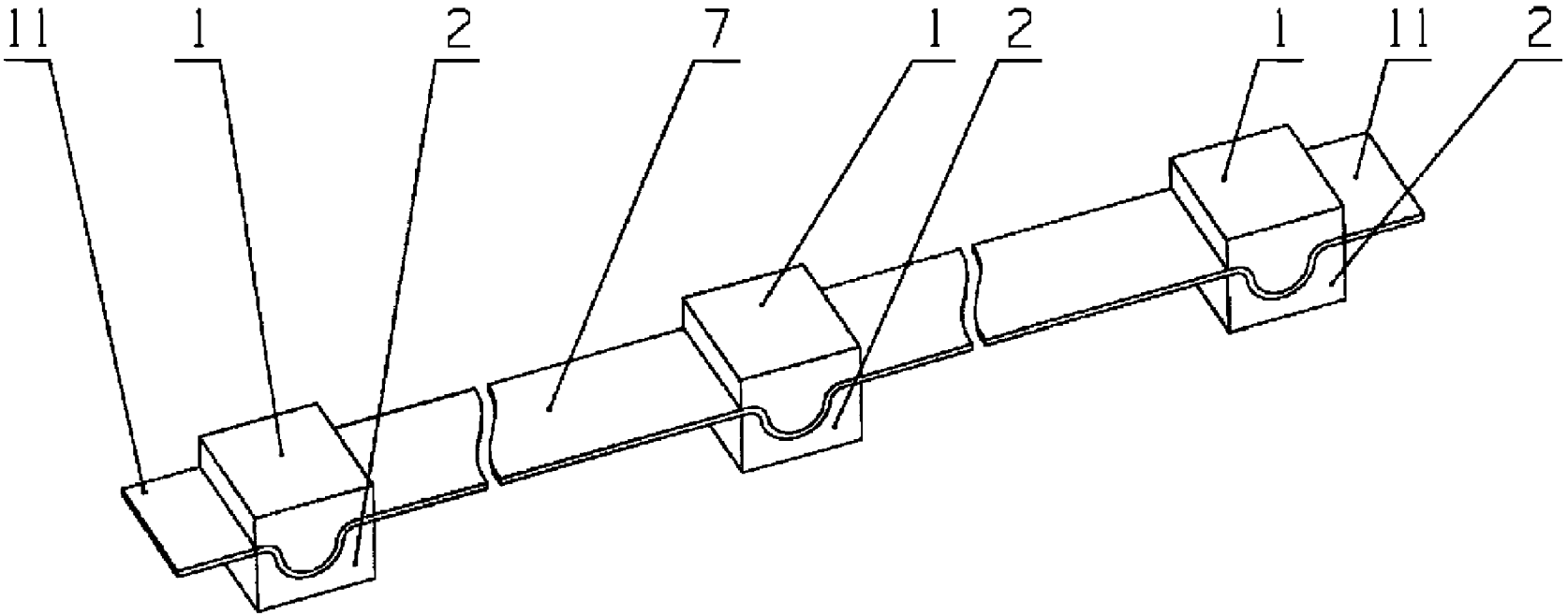
FIG. 8 is a representative view of the extra-long ribbon loudspeaker (a portion with the diaphragm) used with the separate support structure.
Figure 9:
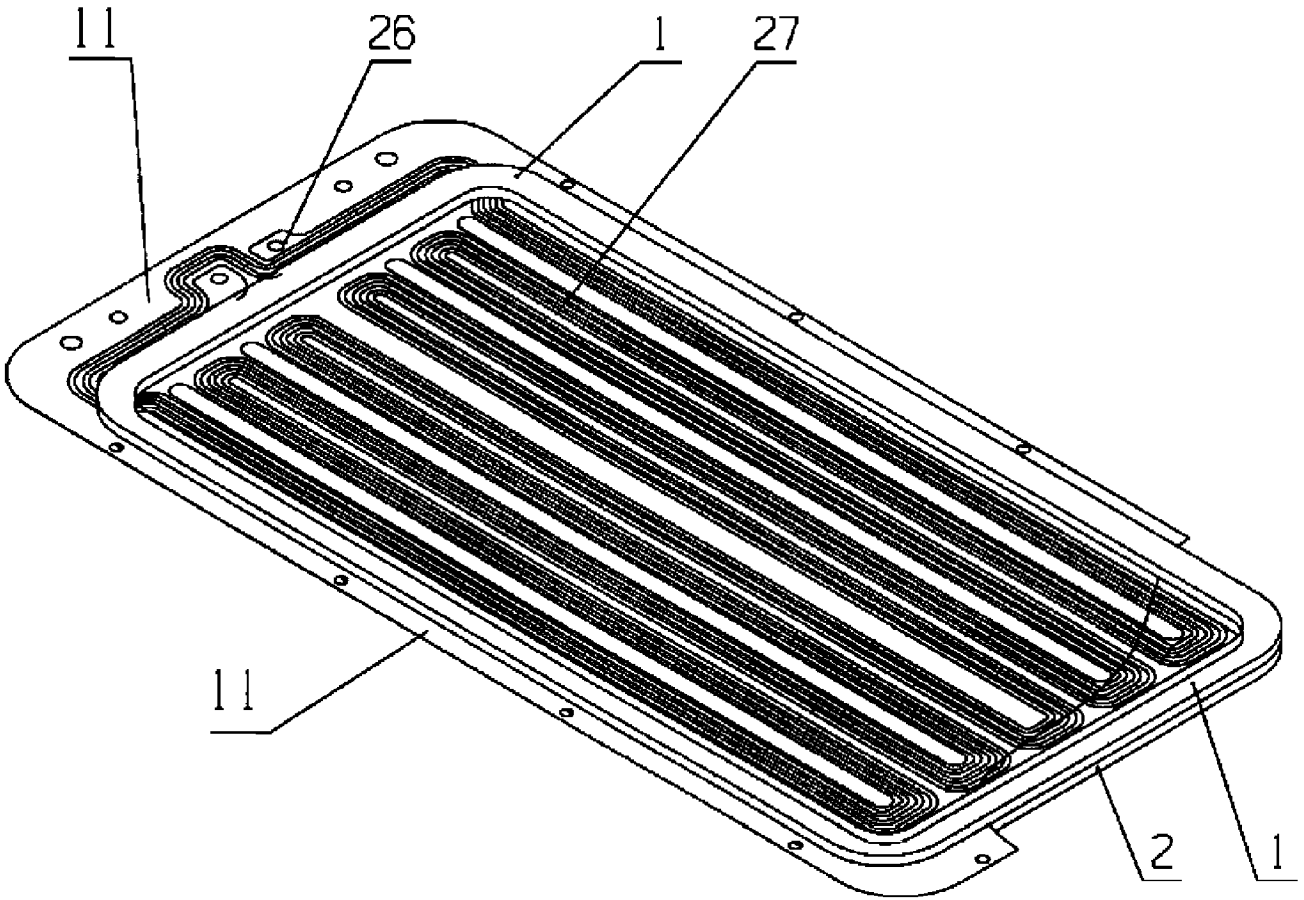
FIG. 9 is the exemplar diagram of the planar-film loudspeaker (a portion with the diaphragm) used with the separate support structure.

Also, the support structure shown in FIG. 2 is the combination of the curved-surface elastic body and the supported portion in the ribbon loudspeaker and the planar-film loudspeaker which comprise the flexible diaphragm. Normally, the flexible diaphragm has a fixed section or a fixed area where the diaphragm is fixedly connected to a loudspeaker body so as to fix the diaphragm; the separate support structure formed by the curved-surface elastic bodies serves to support and tension the flexible diaphragm so that the diaphragm is positioned at a center working region. When the supported portion of the diaphragm is under the action of the drive forcing from an audio signal, both the engaged faces of the two curved-surface elastic bodies open or close so that the diaphragm can stretch or withdraw; the separate support structure supports and keeps the diaphragm vibrating within a predetermined amplitude, while ensures that the vibration of the diaphragm does not exceed an elasticity limit. In the ribbon loudspeaker, the position of the curved-surface elastic bodies 1, 2 is generally provided in the inside of the fixed section of ribbon diaphragm, and the elastic body may be provided on either end or both ends of the ribbon diaphragm. In addition, in the extra-long ribbon loudspeaker diaphragm and the support structure of the curved-surface elastic body shown in FIG. 8, if the length of the ribbon diaphragm is longer than 300 mm in the extra-long ribbon loudspeaker as shown in the figure, one pair or more pairs of curved-surface elastic bodies may be arranged at the middle of the diaphragm in order to further support and stabilize the flexible diaphragm. As shown in FIG. 9, in the planar-film loudspeaker, the position of the separate support structure including curved-surface elastic bodies 1 and 2 is generally between a flexible conductive circuit 27 and a retaining ring of the diaphragm.

Furthermore, in the case that the loudspeaker diaphragm is flexible one, the minimum curvature radius of the first curved-surface elastic body 1 and the second curved-surface elastic body 2 is larger than or equal to the minimum allowable flex radius of the flexible diaphragm 7. Meanwhile, the difference between a length of a curved-surface line of a section plane of the first and second elastic bodies and a length of a straight line of the section plane of the first and second elastic bodies is larger than or equal to the difference between a line length of the diaphragm at its maximum amplitude and a line length of the diaphragm at minimum amplitude.

Figure 3:
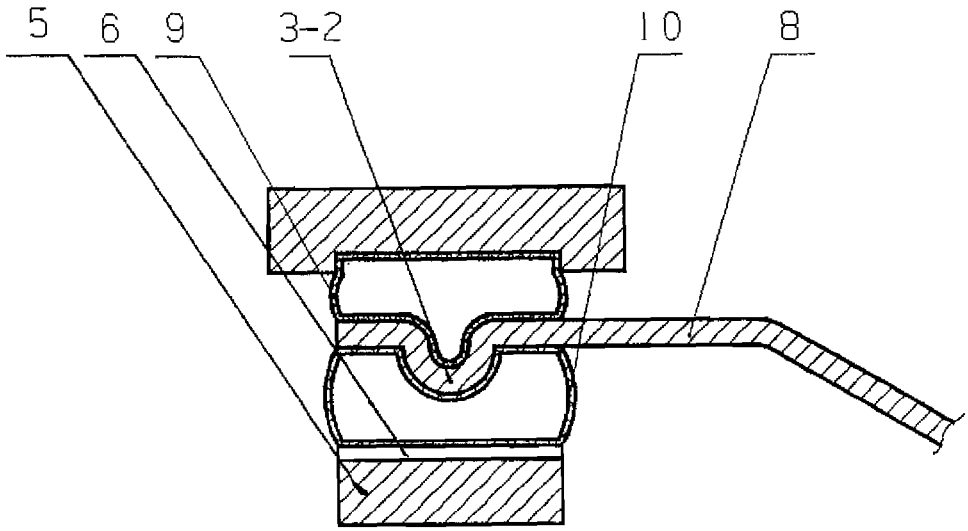
FIG. 3 is a sectional view of the support structure of the loudspeaker diaphragm according to a second embodiment of the invention.

FIG. 3 shows the support structure of the loudspeaker diaphragm according to the second embodiment of the present invention. Similarly, the structure shown in FIG. 3 is also a separate support structure for the loudspeaker diaphragm. In comparison with the structure shown in FIG. 2, the loudspeaker diaphragm in FIG. 3 is a rigid diaphragm 8, which has a rigid supported portion 3-2. The first curved-surface elastic body 9 and the second curved-surface elastic body 10 are both hollow elastic pieces, which are made of resilient material of macromolecule. Similarly, the supported portion 3-2 of the rigid diaphragm 8 is sandwiched between the first engaged face of the first curved-surface elastic body 9 and the second engaged face of the second curved-surface elastic body 10 so that it is able to support and retain the loudspeaker diaphragm. As shown in the figure, the first hollow curved-surface elastic body 9 has a convex curved-surface shape and the second hollow curved-surface elastic body 10 has a concave curved-surface shape, the both curved-surface faces of the elastic bodies 9 and 10 engage and match each other, the supported portion 3-2 of the rigid diaphragm is sandwiched between the two complementary curved surfaces, and the supported portion 3-2 of the rigid diaphragm has a suitable shape that matches with the curved surfaces of the curved-surface elastic bodies 9, 10. Meanwhile, in order to maintain the stability in a radial direction during the compression of hollow curved-surface elastic bodies, the hollow curved-surface elastic bodies may be configured in a drum structure. Similarly, the supported portion 3-2 of the rigid diaphragm and the first and second elastic bodies 9, 10 form as a separate structure, that is, there is no any connection means, such as an adhesive, between them.

The first curved-surface elastic body 9 is fixed in the first fixation member 4 by means of insertion, while the second elastic body 10 is fixed in the second fixation member 5 by means of an adhesive. The connection means between the fixation member and the elastic bodies is not limited, and the connection means may be selected according to the operation environment and manufacture technology.

It is to be again noted that the separate support structure shown in FIG. 3 is the combination of rigid supported portion 3-2 and the curved-surface elastic bodies 9, 10, this kind of support structure can subject to vibration and maintain its curved shape. The support structure of curved-surface elastic body allows the rigid diaphragm to vibrate under a driving force in the direction of the vertical axis (perpendicular to a plane of the diaphragm), and the support structure with the curved-surface elastic bodies can further stabilize the radial position of the rigid diaphragm.

When the loudspeaker diaphragm is rigid one, the minimum resilient displacement of the elastic body is larger than or equal to the maximum vibration amplitude of the loudspeaker diaphragm.

Figure 4:
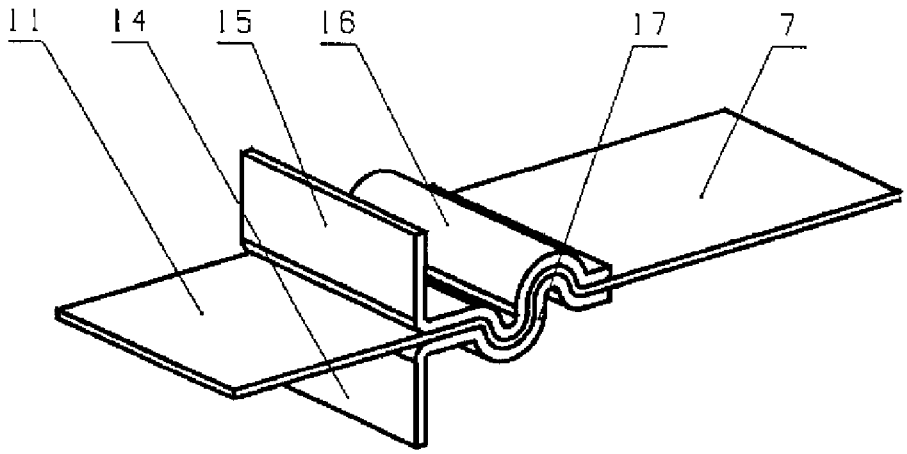
FIG. 4 is a sectional view of the support structure of the loudspeaker diaphragm according to a third embodiment of the invention.

FIG. 4 shows a support structure of metallic thin plate for a diaphragm according to the third embodiment of the present invention. The support structure includes a first metallic curved-surface elastic body 16 having a first engaged face and a second metallic curved-surface elastic body 17 having a second engaged face, the engaged faces of the two metallic curved-surface elastic bodies 16 and 17 have S-shape curved matching surfaces, a diaphragm is sandwiched between the two engaged faces which are complementarily matched together. It should be noted that the separate support structure is formed of the supported portion and the first and second elastic bodies 16, 17, that is, there is no connection means, such as an adhesive, between them.

The first and second metallic curved-surface elastic bodies have fixation sections 14 and 15 for the elastic bodies, respectively, so that they may be connected to the loudspeaker body by means of welding, a fastener, or an insertion slot. In the illustrated embodiment the flexible diaphragm 7 is sandwiched between the metallic curved-surface elastic bodies. In such a manner, the metallic curved-surface elastic bodies can support and maintain the positioning of the rigid diaphragm and keep its vibration as well. The metallic curved-surface elastic body may be made of material such as phosphor bronze and beryllium copper, etc.

The curved-surface shape of the elastic body in the support structure may be various, for example in the shapes of waveform, sinusoidal waveform, S-form, V-form, U-form, C-form, M-form, W-form and so on.

Figure 6:
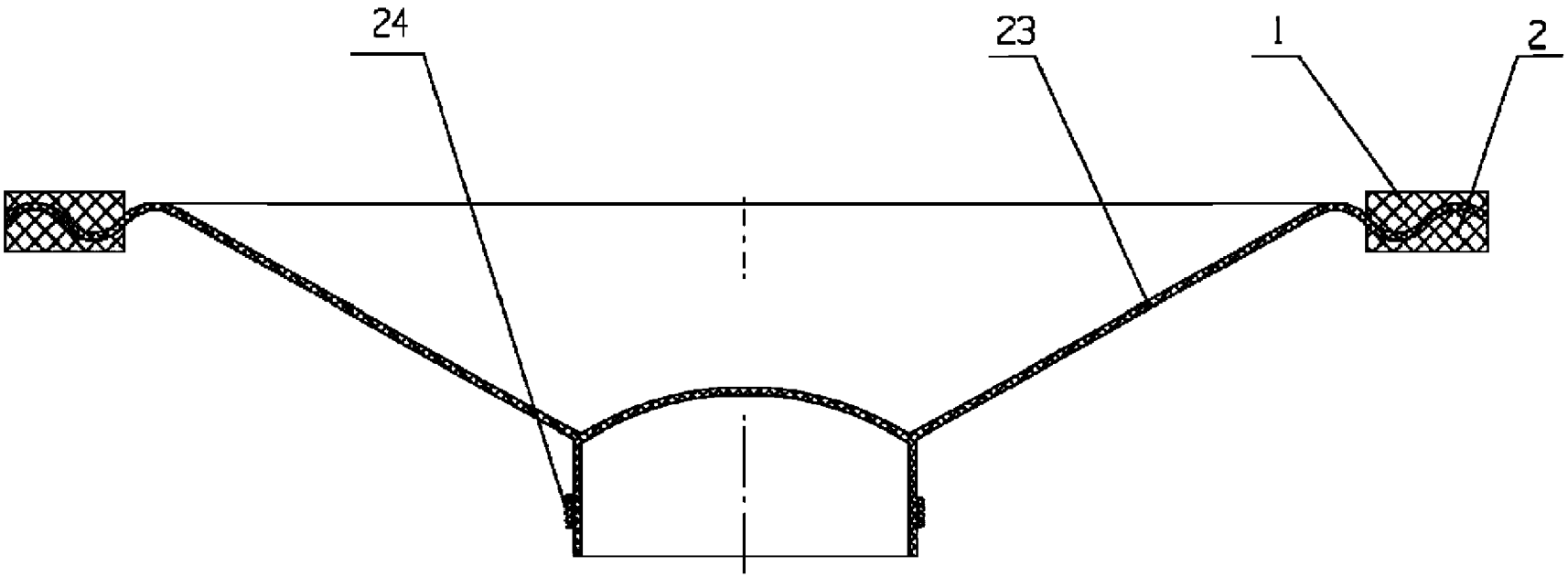
FIG. 6 is a representative view of the cone loudspeaker used with the separate support structure.
Figure 7:
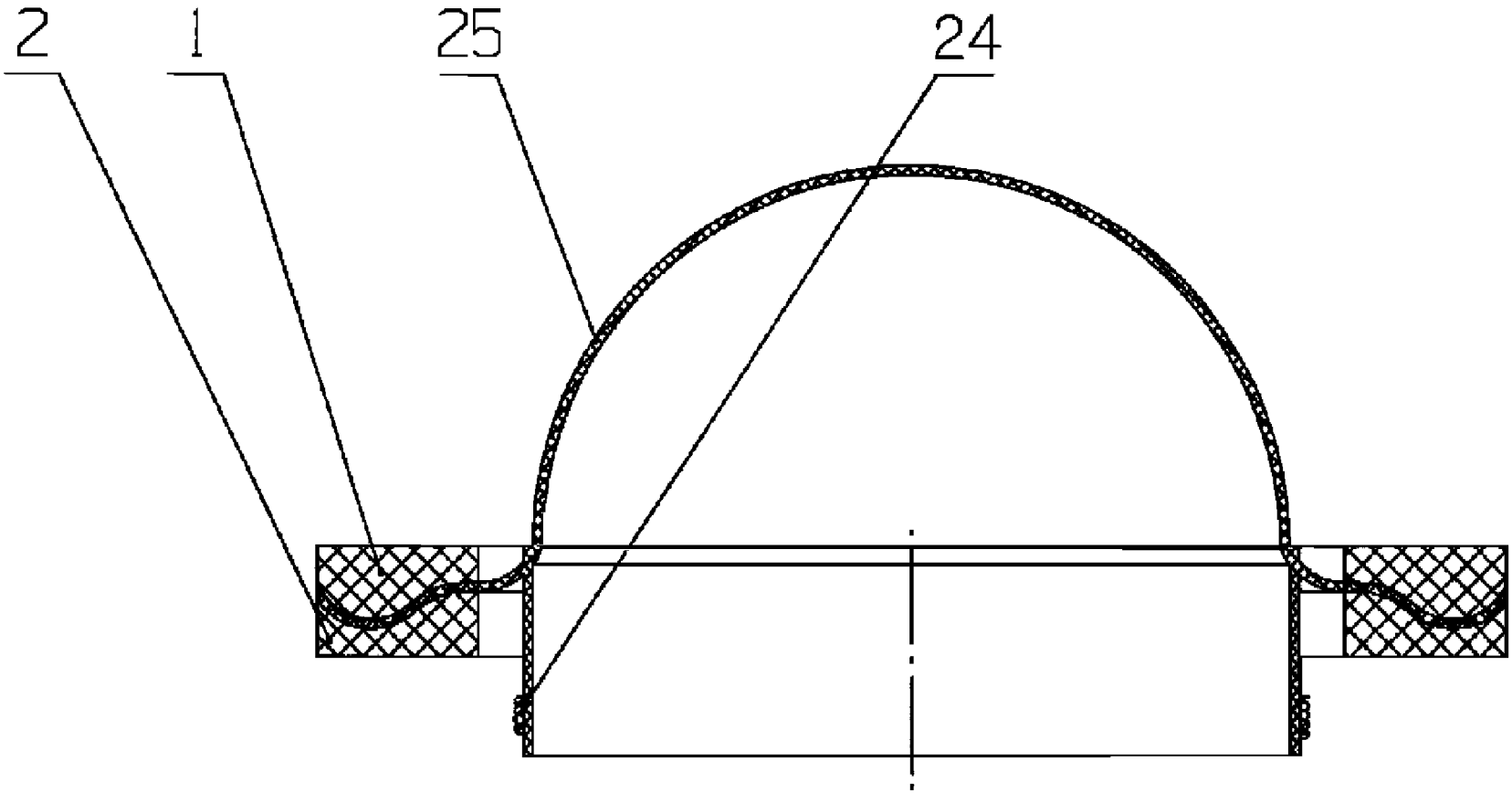
FIG. 7 is a representative view of the dome high-pitch loudspeaker used with the separate support structure.

It can be found from the above mentioned embodiments that the separate support structure according to the invention may be not only used in the loudspeaker having the flexible diaphragm, such as the ribbon loudspeaker, planar-film loudspeaker as well as the dome-section high-pitch loudspeaker; but also may be used in the loudspeaker having the rigid diaphragm, such as the cone loudspeaker as shown in FIG. 6 and the dome high-pitch loudspeaker as shown in FIG. 7. As shown in FIG. 6, a cone diaphragm 23 in the cone loudspeaker is sandwiched and fixed between the first curved-surface elastic body 1 and the second curved-surface elastic body 2; as shown in FIG. 7, a dome diaphragm 25 in the dome high-pitch loudspeaker is sandwiched and fixed between the first curved-surface elastic body 1 and the second curved-surface elastic body 2.

Figure 5:
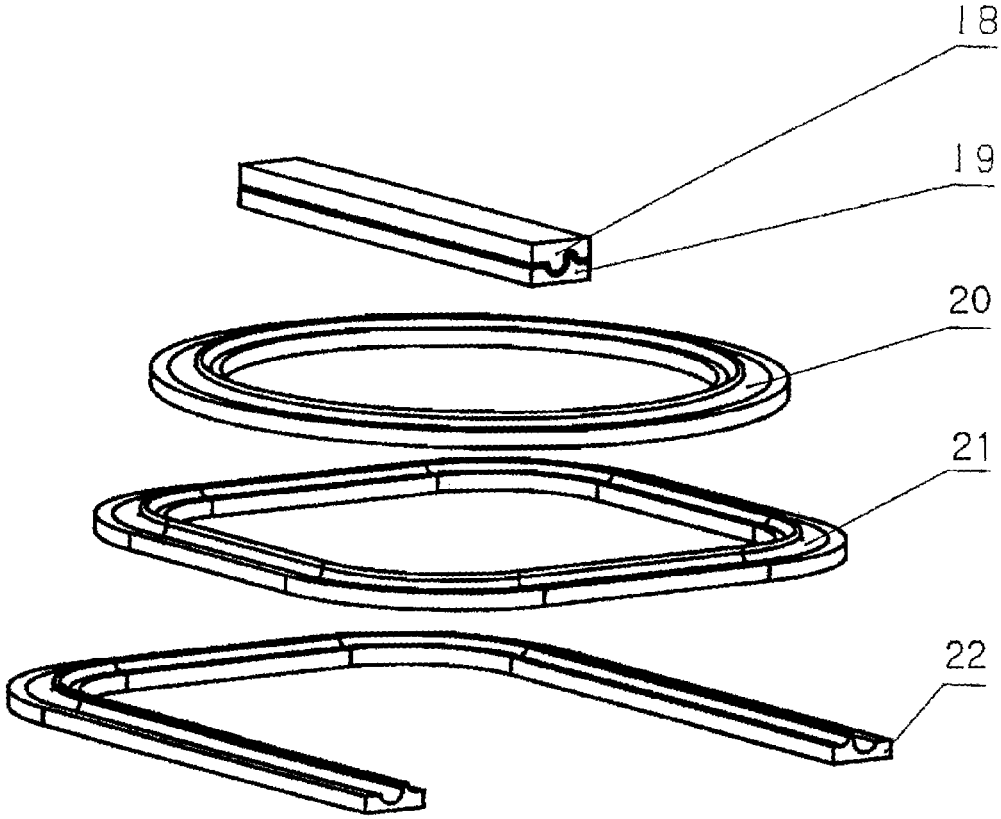
FIG. 5 shows an overall configuration of various support structures.

The entire configuration of the elastic body may have many embodiments according to the type of the loudspeaker and the diaphragm structure. FIG. 5 shows some configurations, wherein reference numerals 18 and 19 show a bar-shaped curved-surface elastic body, reference numeral 20 shows a circular curved-surface elastic body, reference numeral 21 shows a square curved-surface elastic body with rounded corner, and reference numeral 22 shows a U-shaped curved-surface elastic body. Furthermore the elliptical shape may also be adopted as the entire shape.

The foregoing description is representative. The skilled in the art may make modifications without departing the main intension and spirit of the invention, for example, the hollow curved-surface elastic body can be used in combination with the flexible diaphragm, or the solid curved-surface elastic body can be used in combination with the rigid diaphragm. The scope for protection of the invention is determined by the attached claims.

What is claimed is:

1. A support structure for a loudspeaker diaphragm, wherein the support structure is used for positioning the loudspeaker diaphragm and keeping the diaphragm vibrating, and the support structure is a separate support structure, which comprises:

a first elastic body which has a first engaged face having a curved-surface shape;

a second elastic body which has a second engaged face, a curved-surface shape of the second engaged face complementarily matches the curved-surface shape of the first engaged face; and a supported portion of the loudspeaker diaphragm;

the first engaged face of the first elastic body and the second engaged face of the second elastic body engage each other to clamp the supported portion in opposite relation from two sides of the supported portion of the loudspeaker diaphragm, there is no other connecting means between the elastic bodies and the diaphragm.

2. The support structure according to claim 1, wherein an engaged face between the first curved-surface elastic body and the second curved-surface elastic body is curved, the shape of the engaged face for the curved elastic body is one of the following: waveform, sinusoidal waveform, S-form, U-form, V-form, C-form, W-form and M-form.

3. The support structure according to claim 1, wherein the diaphragm is flexible, from the two sides of the flexible diaphragm, the first engaged face of the first elastic body and the second engaged face of the second elastic body engage to clamp the supported portion of the flexible diaphragm in opposite relation.

4. The support structure according to claim 3, wherein the flexible diaphragm has a fixed section which connects the diaphragm to the loudspeaker body, the elastic body is arranged at inside of the fixed section, and the curved-surface elastic bodies are provided on either or both ends of the flexible diaphragm.

5. The support structure according to claim 4, wherein the loudspeaker is a ribbon loudspeaker, and a length of the diaphragm is not smaller than 300 mm, there is at least one pair of elastic bodies arranged at the middle of the diaphragm, the elastic bodies have the complementary engaged faces with the curved shape and clamp the diaphragm from the two sides.

6. The support structure according to claim 1, wherein the loudspeaker is a planar-film loudspeaker, and the position of the support structure with the elastic bodies is between a flexible conductive circuit and a retaining ring of the diaphragm.

7. The support structure according to claim 1, wherein the diaphragm is rigid, from the two sides of the rigid diaphragm, the first engaged face of the first elastic body and the second engaged face of the second elastic body engage with each other to clamp the supported portion of the rigid diaphragm in opposite relation.

8. The support structure according to claim 1, wherein minimum curvature radiuses of the first curved-surface elastic body and the second curved-surface elastic body are larger than or equal to a minimum allowable flex radius of the flexible diaphragm.

9. The support structure according to claim 1, wherein the difference between a length of a curved line and a length of a straight line of a section plane of the first and second elastic bodies is larger than or equal to the difference between a line length of the diaphragm at its maximum amplitude and a line length of the diaphragm at its minimum amplitude.

10. The support structure according to claim 7, wherein a minimum resilient displacement of the curved-surface elastic body is larger than or equal to a maximum amplitude of the loudspeaker diaphragm.

* * * * *